US011064856B1

(12) United States Patent
Afrouzi et al.

(10) Patent No.: US 11,064,856 B1
(45) Date of Patent: Jul. 20, 2021

(54) DETACHABLE ROBOTIC VACUUM DUSTBIN

(71) Applicant: AI Incorporated, Toronto (CA)

(72) Inventors: Ali Ebrahimi Afrouzi, Toronto (CA); Soroush Mehrnia, Toronto (CA)

(73) Assignee: AI Incorporated, Toronto (CA)

( * ) Notice: Subject to any disclaimer, the term of this patent is extended or adjusted under 35 U.S.C. 154(b) by 434 days.

(21) Appl. No.: 16/186,499

(22) Filed: Nov. 10, 2018

Related U.S. Application Data

(63) Continuation of application No. 14/885,064, filed on Oct. 16, 2015, now abandoned.

(60) Provisional application No. 62/066,781, filed on Oct. 21, 2014.

(51) Int. Cl.
*A47L 9/14* (2006.01)
*A47L 11/40* (2006.01)

(52) U.S. Cl.
CPC ..... *A47L 9/1409* (2013.01); *A47L 11/4005* (2013.01); *A47L 11/4036* (2013.01); *A47L 11/4066* (2013.01); *A47L 11/4072* (2013.01); *A47L 2201/06* (2013.01)

(58) Field of Classification Search
CPC ..... A47L 9/1409; A47L 11/4066; A47L 11/4036; A47L 11/4072; A47L 11/4005; A47L 2201/06
See application file for complete search history.

(56) References Cited

U.S. PATENT DOCUMENTS

| | | | |
|---|---|---|---|
| 6,883,201 | B2 | 4/2005 | Jones et al. |
| 7,201,786 | B2 | 4/2007 | Wegelin et al. |
| 7,937,800 | B2 | 5/2011 | Yan |
| 8,209,053 | B2 | 6/2012 | Kim et al. |
| 8,505,158 | B2 | 8/2013 | Han et al. |
| 8,528,157 | B2 | 9/2013 | Schnittman et al. |
| 8,572,799 | B2 | 11/2013 | Won et al. |
| 8,671,507 | B2 | 3/2014 | Jones et al. |
| 8,741,013 | B2 | 6/2014 | Swett et al. |
| 8,984,708 | B2 | 3/2015 | Kuhe et al. |

OTHER PUBLICATIONS

"IRobot Roomba Vacuum Cleaning Robot 500/600 Series Owner's Manual", https://homesupport.irobot.com/euf/assets/images/faqs/roomba/500/manual/en-US.pdf, 2009, pp. 1-36.

*Primary Examiner* — David Redding

(57) ABSTRACT

A removable dustbin for a robotic vacuum that is wholly separable from all electronic parts thereof including a motor unit such that the dustbin, when separated from the electronic parts, may be safely immersed in water for quick and easy cleaning. The dustbin design further facilitates easy access to the motor for convenient servicing and repair.

20 Claims, 2 Drawing Sheets

DETACHABLE ROBOTIC VACUUM DUSTBIN

CROSS-REFERENCE TO RELATED APPLICATIONS

This application is a continuation of U.S. patent application Ser. No. 14/885,064, filed 16 Oct. 2015, which claims the benefit of Provisional Patent Application 62/066,781, filed Oct. 21, 2014, the entire contents of each of which is hereby incorporated by reference.

FIELD OF INVENTION

The present invention relates to robotic vacuums. More particularly, the invention relates to a dustbin or debris container for a robotic vacuum.

BACKGROUND OF INVENTION

The following is a tabulation of some prior art that presently appears relevant:

U.S. Pat. Documents

| Pat. No. | Kind Code | Issue Date | Patentee |
|---|---|---|---|
| 6,883,201 | B2 | Apr. 26, 2005 | Irobot Corporation |
| 8,741,013 | B2 | Jun. 3, 2014 | Irobot Corporation |
| 8,572,799 | B2 | Nov. 5, 2013 | Irobot Corporation |
| 8,528,157 | B2 | Sep. 10, 2013 | Irobot Corporation |
| 8,505,158 | B2 | Aug. 3, 2013 | Samsung Electronics Co., Ltd. |
| 8,984,708 | B2 | Mar. 24, 2015 | Irobot Corporation |
| 7,201,786 | B2 | Apr. 10, 2007 | The Hoover Company |
| 8,671,507 | B2 | Mar. 18, 2014 | Irobot Corporation |
| 7,937,800 | B2 | May 10, 2011 | Jason Yan |
| 8,209,053 | B2 | Jun. 26, 2012 | Samsung Electronics Co., Ltd. |

Robotic devices are becoming increasingly popular for carrying out routine tasks, like mopping, vacuuming and cutting grass. However, the majority of these robots still require some human aid in order to operate. Robotic vacuum cleaners and floor scrubbers, for example, have holding cavities where debris is collected that must be regularly emptied. The emptying of a dustbin in a robotic vacuum is often cumbersome and imprecise. The motor/impeller unit in robotic vacuum cleaners is sometimes located inside the chassis adjacent to the dustbin or is connected to the dustbin via a duct. These models, however, make access to the motor/impeller for occasional repair or servicing difficult due to their location within the chassis. One solution to this problem is fixing the motor/impeller directly inside a removable dustbin. This provides better access to the impeller and motor when the dustbin is removed.

However, the malfunction of any one of these connected parts in similar designs requires either extensive manual work to disassemble the unit or replacement any of them, which imposes an additional unnecessary cost on the user. Furthermore, the positioning of electronics inside the dustbin means that the dustbin may not be immersed in water for thorough and easy washing.

Robotic vacuum dustbins are usually emptied by shaking debris out manually or brushing debris out with a tool. This process, however, inevitably leaves behind a small amount of debris that cannot be removed by a brush or by cursory shaking. Furthermore, small particles often become airborne in this process, which may be irritating or unpleasant for the user, especially if those particles are inhaled or enter the eyes.

A need exists for an improved robotic vacuum dustbin design that allows both easy access to the motor/impeller and permits the dustbin to be immersed in water for easy cleaning.

SUMMARY OF INVENTION

It is an object of the present invention to provide a dustbin for a robotic vacuum that is wholly separable from the electronic parts thereof.

It is an object of the invention to provide a dustbin for a robotic vacuum that may be safely immersed in water.

It is an object of the invention to provide a dustbin for a robotic vacuum that enables easy access to the motor/impeller.

The aforementioned objectives are achieved by the present invention through a robotic vacuum dustbin that is wholly separable from all electronic parts thereof. In the proposed design, the motor and impeller are attached to the dustbin by one or more latches that can be released to easily separate them from the dustbin.

DETAILED DESCRIPTION OF THE INVENTION

The present invention will now be described in detail with reference to an embodiment thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Various embodiments are described below, including methods and techniques. The disclosure described herein is directed generally to a utilitarian dustbin design for a robotic vacuum.

As understood herein, the term "robotic vacuum" may be defined generally to include one or more autonomous devices having communication, mobility, vacuuming and/or processing elements. For example, a robotic vacuum may comprise a casing or shell, a chassis including a set of wheels, a motor to drive wheels, a receiver that acquires signals transmitted from, for example, a transmitting beacon, a processor, and/or controller that processes and/or controls motor and other robotic autonomous or cleaning operations, network or wireless communications, power management, etc., one or more clock or synchronizing devices, a vacuum motor to provide suction, a dustbin to store debris, a brush to facilitate collection of debris, and a means to spin the brush.

Generally, a removable dustbin is provisioned with a removable motor unit disposed therein. It should be understood that the present invention has broad applicability and utility. Any embodiment discussed and identified as "preferred" is considered to be part of one of the best modes for carrying out the present invention. A robotic vacuum is used to illustrate one embodiment of the invention, however, the invention may be used for various robotic devices, such as robotic polishers that polish floors, robotic lawn mowers, and similar devices that operate autonomously. Additionally, unless otherwise noted, specifications are given for illustrative purposes and shall not be understood as limiting the possibilities of alternative examples.

The present invention proposes a dustbin design for a robotic vacuum or other robotic device that both provides convenient access to the motor unit by housing it within the dustbin and is easily separated from the motor unit to facilitate the individual repair, servicing, or washing of the parts.

Figure 1A:
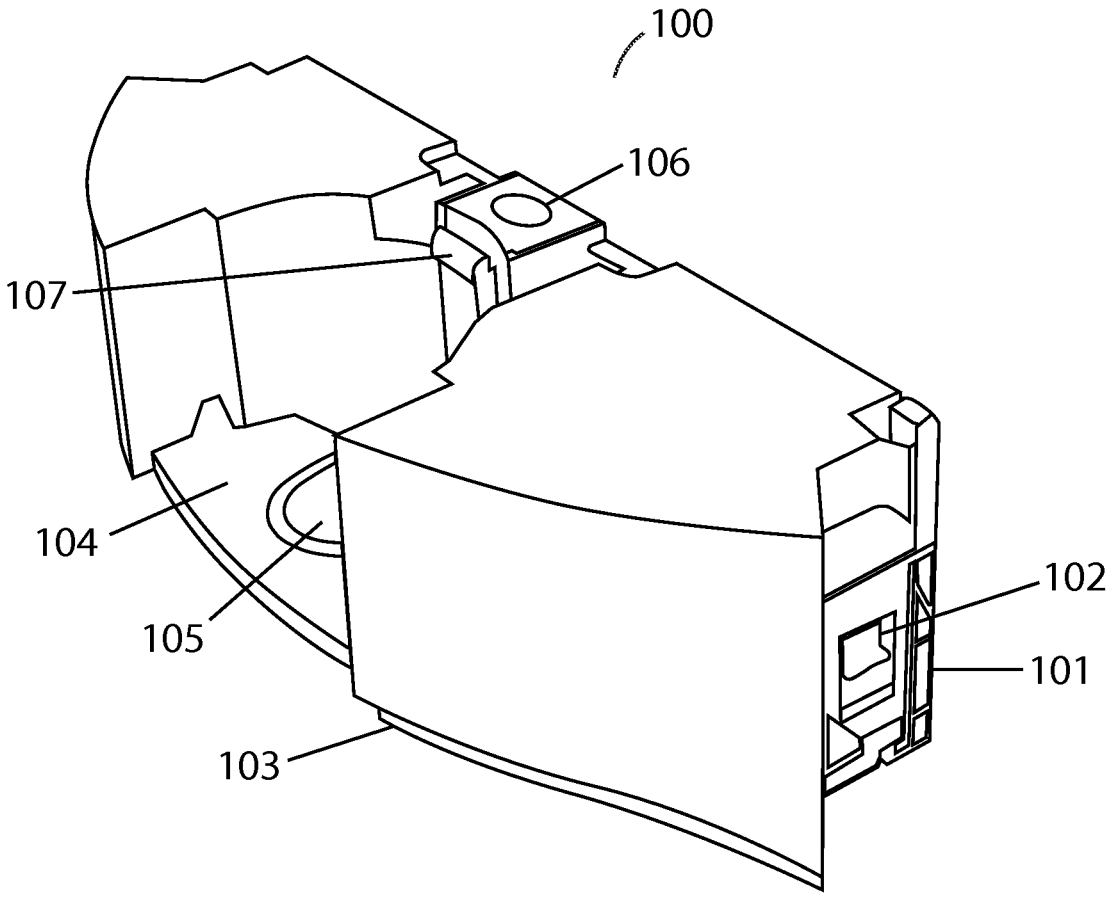
FIG. 1A illustrates a robotic vacuum dustbin with the motor unit removed embodying features of the present invention.

Referring to FIG. 1A, a dustbin 100 for a robotic vacuum is illustrated. The dustbin comprises a window 101 for receiving debris; window releases 102 that allow the window to be opened when depressed; and a filter 103 that keeps vacuumed debris particles from entering the motor. The open space at the back of the dustbin is the motor compartment 104 where the vacuum's electric motor sits and pulls the air through the opening 105 in the bottom of the motor compartment area. A release button 106 releases the latch 107 that holds the motor in its compartment in the dustbin.

Figure 1B:
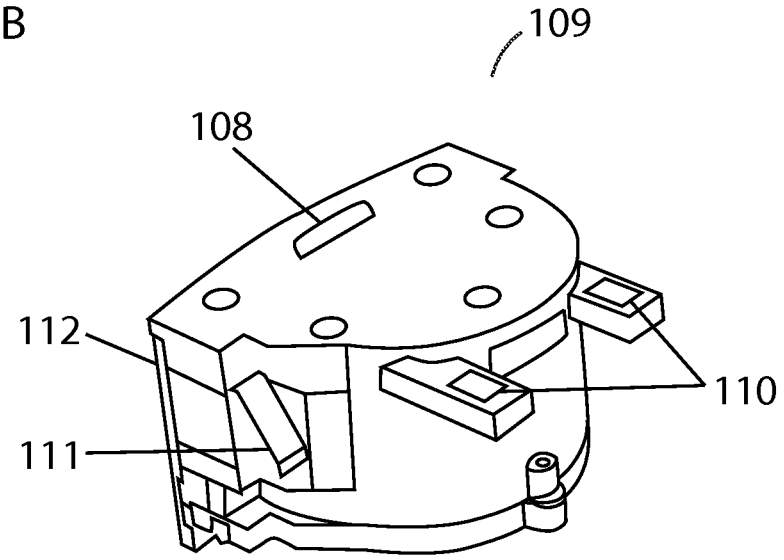
FIG. 1B illustrates the removed robotic vacuum motor unit embodying features of the present invention.

Referring to FIG. 1B, the electric vacuum motor 109 is illustrated. Referring briefly to both FIGS. 1A and 1B, the electric vacuum motor 109 fits in the motor compartment 104 and may be ejected from the motor compartment when desired. Referring back to FIG. 1B, prongs 111 eject the motor from its compartment when it is released. The motor is powered by a battery in the chassis (not shown) through electrodes 110. An air filter 112 is provided behind the vacuum motor to filter the outtake air as it exits the vacuum. A latch 108 secures the dustbin to the chassis when the motor is in its compartment.

When the electric vacuum motor is removed from the dustbin, the dustbin is free of electronic parts and thus may be immersed in water for cleaning. Removability of the motor also improves accessibility to the motor for repairs or replacement.

Figure 2:
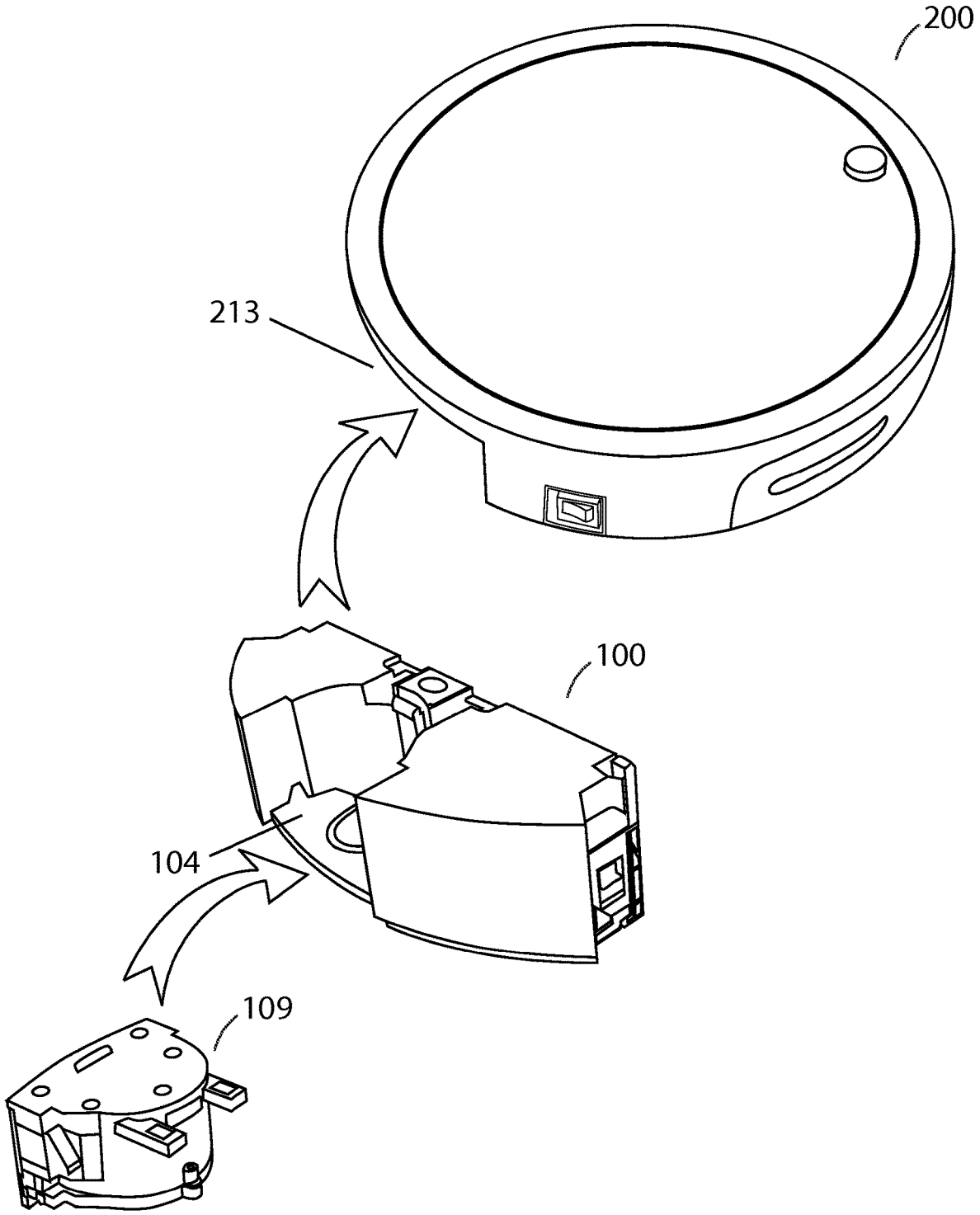
FIG. 2 illustrates the installation of the motor and impeller unit into the dustbin and the dustbin into the robotic vacuum chassis embodying features of the present invention.

Referring to FIG. 2, the installation of the vacuum motor 109 into the dustbin 100 and the dustbin 100 into the robot chassis 200 is illustrated. As depicted, the vacuum motor 109 is inserted into the compartment 104 in the dustbin first, then the dustbin 100 is inserted into the compartment 213 in the robot chassis 200.

We claim:

1. A robotic vacuum, comprising:

a dustbin configured to receive debris vacuumed by the robotic vacuum;

an assembly with a motor, the motor being an electric motor configured to drive suction for the robotic vacuum by which the debris is vacuumed by the robotic vacuum; and a release assembly comprising:

a button; and a latch configured to couple the dustbin to the assembly with the motor, wherein the release assembly is configured to respond to the button being pressed by both:

transitioning the latch from a first state that holds the dustbin to the assembly with the motor to a second state that releases the dustbin from the assembly with the motor; and ejecting the dustbin from the assembly with the motor, wherein the dustbin is configured to be freed of attachment to electronic parts unsuitable for immersion in water by the response of the release assembly to the button being pressed.

2. The robotic vacuum of claim 1, wherein:

the release assembly comprises a prong configured to eject the dustbin from the assembly with the motor in response to the button being pressed.

3. The robotic vacuum of claim 1, wherein:

the release assembly comprises a plurality of prongs configured to eject the dustbin from the assembly with the motor in response to the button being pressed.

4. The robotic vacuum of claim 1, wherein:

the dustbin comprises an opening through which air is pulled by the suction driven by the motor; and the opening is configured to receive a frame of a removeable filter.

5. The robotic vacuum of claim 1, wherein the release assembly is configured to respond to the button being pressed by providing access to the electric motor.

6. The robotic vacuum of claim 1, comprising:

a right circular cylindrical-shaped shell that, when coupled with the dustbin, is configured to form a right circular cylinder;

a chassis with a plurality of wheels;

another electric motor configured to drive the wheels;

a brush configured to collect debris;

a receiver configured to acquire signals;

a processor configured to control the motors; and a battery configured to supply power, wherein:

the dustbin comprises an exterior wall forming an arc-shape with a radius matching a radius of circular cylinder, and the dustbin defines a portion of a void in which at least part of the motor of the motor assembly is disposed.

7. The robotic vacuum of claim 1, wherein the dustbin comprises:

a window through which the robotic vacuum is configured to pass the debris; and a window release configured to open the window in response to the window release being pressed.

8. The robotic vacuum of claim 1, comprising an air filter located on a side of the dustbin.

9. The robotic vacuum of claim 1, wherein the dustbin is free of electronic parts.

10. The robotic vacuum of claim 1, comprising multiple removeable filters coupled to the dustbin.

11. The robotic vacuum of claim 1, wherein the robotic vacuum is configured to prevent electric power from being supplied to the motor in response to the button being pressed.

12. The robotic vacuum of claim 1, wherein the assembly with the motor comprises one or more impellers to suck air.

13. The robotic vacuum of claim 1, comprising a brush extending parallel to an interior wall of the dustbin.

14. The robotic vacuum of claim 13, wherein the brush axis is parallel to at least one of the wheels.

15. The robotic vacuum of claim 1, wherein removal of the dustbin from the assembly with the motor provides access to the motor.

16. The robotic vacuum of claim 1, wherein the dustbin defines an airflow path through:

a first aperture in a sidewall of the dustbin;

an interior cavity of the dustbin; and a filter through which air is sucked by the motor.

17. The robotic vacuum of claim 1, comprising:

a shell having a void that is complementary to a shape of the dustbin.

18. The robotic vacuum of claim 17, wherein:

the assembly with the motor is a distinct part from the shell and is coupled to the shell via the dustbin.

19. The robotic vacuum of claim 1, wherein the dustbin comprises:

a window; and a window release configured to open the window in response to being pressed.

20. The robotic vacuum of claim 1, comprising:

a chassis and wheels coupled to the chassis, wherein:

the assembly with the motor is coupled to the chassis independently of the dustbin.

* * * * *